US005209689A

United States Patent [19]

Griffin et al.

[11] Patent Number: 5,209,689

[45] Date of Patent: May 11, 1993

[54] METHODS FOR MOUNTING FILAMENTS IN TUBULAR INCANDESCENT LAMP CAPSULES

[75] Inventors: Robert M. Griffin, Hamilton; Peter R. Gagnon, Topsfield; Stephen J. Leadvaro, Salem; Roy C. Martin, Peabody, all of Mass.

[73] Assignee: GTE Products Corporation, Danvers, Mass.

[21] Appl. No.: 814,739

[22] Filed: Dec. 27, 1991

[51] Int. Cl.[5] ..... H01J 9/26

[52] U.S. Cl. ..... 445/27; 445/3; 445/32

[58] Field of Search ..... 445/27, 32, 43, 3, 40

[56] References Cited

U.S. PATENT DOCUMENTS

| | | | |
|---|---|---|---|
| 3,151,922 | 10/1964 | Preschel et al. | 445/43 |
| 3,295,016 | 12/1966 | Ayres et al. | 445/27 |
| 3,462,209 | 8/1969 | Fridrich | 445/27 |
| 3,759,601 | 9/1973 | Bonazoli et al. | 445/27 |
| 4,509,928 | 4/1985 | Morris et al. | 445/27 |

*Primary Examiner*—Richard K. Seidel
*Assistant Examiner*—Jeffrey T. Knapp
*Attorney, Agent, or Firm*—Joseph S. Romanow

[57] ABSTRACT

A method for mounting a filament in a double ended incandescent lamp capsule. A filament assembly, including a filament, filament supports attached to each end of the filament and an external lead connected to each filament support, is located in a tubular lamp envelope. The position of the filament relative to the lamp envelope is determined, and the filament is moved to a predetermined position relative to the lamp envelope, if necessary. Then, the lamp envelope is heated sufficiently to cause the lamp envelope to deform into contact with at least one of the filament supports so as to securely anchor the filament support. The heating of the lamp envelope in regions of the filament supports can be performed simultaneously or at different times. One or both filament supports can be anchored by the tacking process.

13 Claims, 4 Drawing Sheets

METHODS FOR MOUNTING FILAMENTS IN TUBULAR INCANDESCENT LAMP CAPSULES

FIELD OF THE INVENTION

This invention relates to tubular incandescent lamps and, more particularly, to methods for precision mounting of filaments in double ended lamp capsules. The invention is particularly useful for fabricating lamp capsules that have infrared reflective coatings to increase efficiency.

CROSS REFERENCES TO RELATED PATENT APPLICATIONS

U.S. patent application having Ser. Nos. 07/815,004 and 07/815,089, both filed on the same date herewith and both assigned to the assignee hereof, contain related subject matter.

BACKGROUND OF THE INVENTION

Tubular incandescent halogen lamps include a helical filament axially mounted within a quartz lamp envelope. Filament supports attached to the filament support and center the filament within the lamp envelope. The ends of the lamp envelope are hermetically sealed, typically by press sealing. Molybdenum foil conductors electrically connect the filament through the seals to external electrical leads. The interior of the lamp envelope is typically filled with an inert gas and one or more halogen compounds.

It is important to center the filament within the lamp envelope to prevent undesired interactions between the filament and the walls of the lamp envelope. In addition, it is well known that for proper lamp performance, the spacing between coils of the filament must be precisely controlled. This is important because a slight change in filament length significantly changes the operating temperature of the filament. Any change in filament temperature will have a dramatic effect on lamp performance and life.

In one particular lamp type, filament location is even more critical. This type of lamp is known as an infrared conserving lamp, which has a wavelength selective filter coating applied to the outside surface of the lamp envelope. A central region of the lamp envelope adjacent to the filament typically has a geometrically shaped section such as ellipsoidal. The selective filter coating transmits visible radiation and reflects infrared radiation back to the filament. The reflected infrared radiation can significantly reduce the electrical power consumption of the lamp. In order to gain maximum benefit from the reflected infrared radiation, the filament must be very precisely centered on the axis of the lamp envelope. Also, in order for the filament to perform at its design temperature, the filament length must be precisely controlled.

An important component of the tubular incandescent lamp capsule described above is the filament support used to support and center each end of the filament and to conduct electrical energy to the filament. The filament supports are dimensioned to fit the inside diameter of the lamp envelope relatively closely. However, due to the large variation in the inside diameter of the lamp envelope from lamp to lamp, the filament supports must be sized a few thousandths of an inch smaller than the nominal inside diameter of the lamp envelope. It will be recognized that the lack of an intimate fit between the filament supports and the lamp envelope can result in variations in the position of the filament relative to the lamp envelope. Although the sealing process secures the molybdenum foil conductors in fixed positions relative to the lamp envelope, the filament supports may not be securely retained in the lamp envelope of the completed lamp capsule. As a result, the filament may not be positioned with the desired accuracy. Therefore, improved methods for mounting filaments in tubular double ended lamp capsules are required.

It is a general object of the present invention to provide improved tubular incandescent lamp capsules.

It another object of the present invention to provide improved methods for fabricating tubular incandescent lamp capsules.

It is a further object of the present invention to provide improved methods for mounting a filament in a tubular incandescent lamp capsule.

It is yet another object of the present invention to provide methods for accurately positioning a filament within a tubular lamp capsule.

It is still another object of the present invention to provide methods for mounting a filament in a tubular incandescent lamp capsule which are low in cost.

SUMMARY OF THE INVENTION

According to the present invention, these and other objects and advantages are achieved in a method for making a double ended incandescent lamp capsule. The method comprises the steps of positioning a filament assembly in a tubular lamp envelope, the filament assembly comprising a filament and filament supports attached to each end of the filament, heating the lamp envelope sufficiently to cause the lamp envelope to deform into contact with at least one of the filament supports to securely retain the filament support, and sealing the lamp envelope.

The step of positioning the filament assembly typically includes the steps of locating the filament assembly in the lamp envelope, determining the location of the filament relative to the lamp envelope and moving the filament to a predetermined location relative to the lamp envelope when necessary. Typically, the filament comprises a wire coil, and the step of positioning the filament assembly preferably further includes the steps of determining the stretch of the wire coil and adjusting the stretch of the wire coil to a predetermined stretch when necessary.

In a first embodiment, the lamp envelope is heated and deformed in the regions of both filament supports to securely retain both filament supports in fixed positions relative to the lamp envelope. The heating of the lamp envelope in the regions of the filament supports can be performed simultaneously or at different times.

In a second embodiment, one end of the lamp envelope is sealed so as to secure one end of the filament assembly in the lamp envelope. Then, the lamp envelope is heated and deformed in a region adjacent to the filament support at the unsealed end of the lamp envelope. In this embodiment, the lamp envelope is deformed into contact with only one of the filament supports.

Preferably, an inert gas or a reducing gas is flushed through the lamp envelope during the step of heating the lamp envelope to prevent oxidation of metal parts. The pressure within the lamp envelope can be reduced to less than the pressure outside the lamp envelope during the step of heating the lamp envelope to assist in deforming the lamp envelope into contact with the filament support. Also, mechanical pressure can be applied to the heated region of the lamp envelope to deform the lamp envelope into contact with the filament support.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
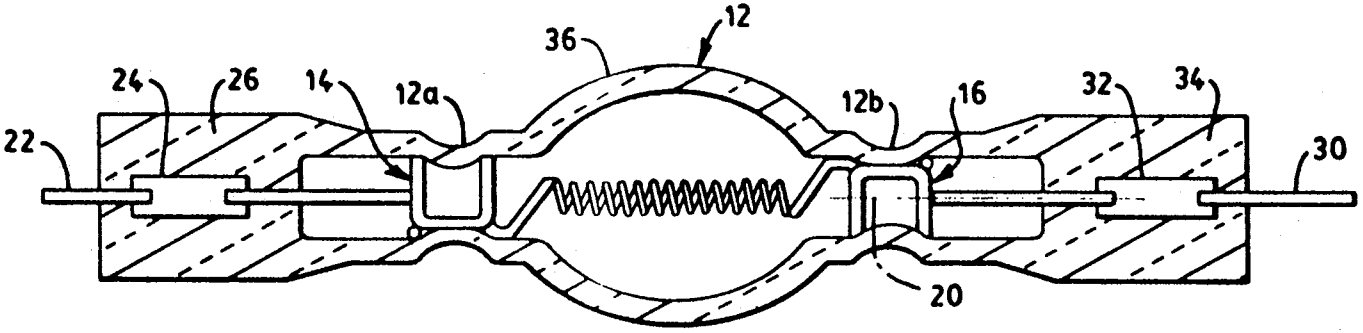
FIG. 1 shows a tubular incandescent lamp capsule fabricated in accordance with the present invention.

A double-ended tubular incandescent lamp capsule fabricated in accordance with the present invention is shown in FIG. 1. A helically coiled filament 10, typically tungsten, is mounted within a tubular lamp envelope 12, typically fabricated of quartz. The filament 10 is supported at each end by filament supports 14 and 16. The filament supports 14 and 16 center the filament 10 on a central axis 20 of lamp envelope 12. Filament support 14 is electrically connected to an external lead 22 by a molybdenum foil conductor 24, which passes through a seal 26. Filament support 16 is electrically connected to an external lead 30 by a molybdenum foil conductor 32, which passes through a seal 34. Seals 26 and 34 hermetically seal the lamp envelope 12. An infrared reflective coating 36 is applied to a surface of lamp envelope 12. As known in the art, coating 36 passes visible light and reflects infrared energy which assists in heating filament 10.

Figure 2A:
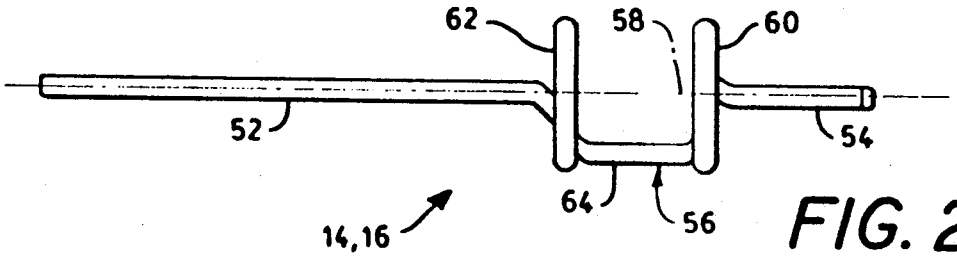
FIGS. 2A–2C show front, side and top views, respectively, of a filament support used in the lamp capsule of FIG. 1.
Figure 2B:
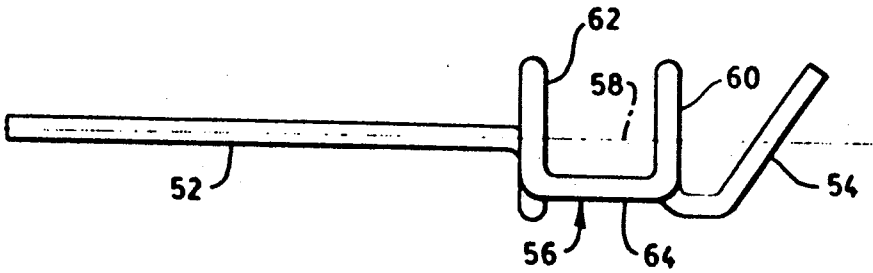
Figure 2C:
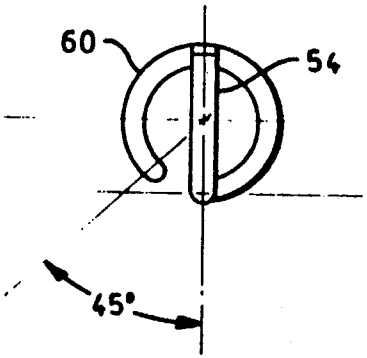

The filament supports 14, 16 are shown in FIGS. 2A–2C. The filament support includes an inlead portion 52, a filament attachment portion 54 and a centering portion 56. The filament support has a central axis 58. The filament attachment portion 54 extends through the central axis 58 at an angle, as best shown in FIG. 2B. The centering portion 56 interconnects inlead portion 52 and filament attachment portion 54, and provides support and accurate centering of the filament 10.

The centering portion 56 includes a first arcuate segment 60 and a second arcuate segment 62. The arcuate segments 60 and 62 are axially spaced apart and are interconnected by an axial segment 64. The inlead portion 52 is connected to one end of arcuate segment 62, and the filament attachment portion 54 is connected to one end of arcuate segment 60. The axial segment 64 interconnects the other ends of arcuate segments 60 and 62.

The arcuate segments 60 and 62 define partial circular regions for contact with the cylindrical inside surface of lamp envelope 12. The contact regions are axially spaced apart by the length of axial segment 64. The outside diameters of arcuate segments 60 and 62 are dimensioned to match the inside diameter of lamp envelope 12 less an allowance for arc tube inside diameter variations. Additional details regarding filament supports 14, 16 are provided in application Ser. No. 07/815,004 entitled Filament Support For Tubular Lamp Capsule, filed concurrently herewith, which is hereby incorporated by reference.

Figure 3:
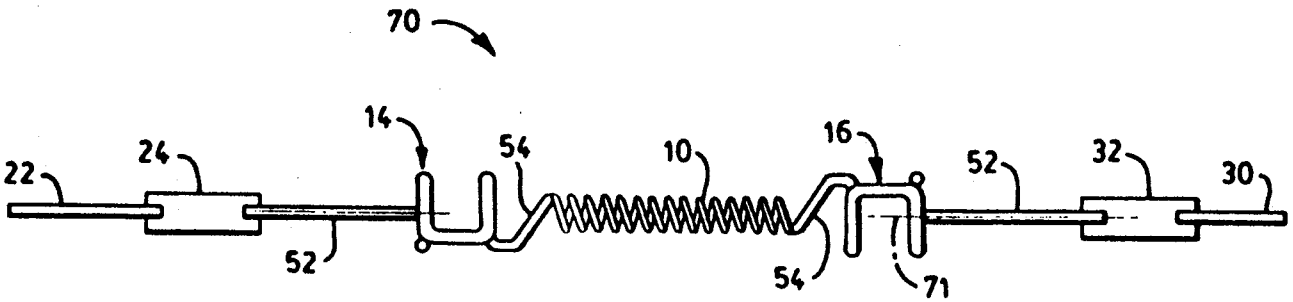
FIG. 3 shows a filament assembly used in the lamp capsule of FIG. 1.

A filament assembly 70 prior to installation in lamp envelope 12 is shown in FIG. 3. The filament attachment portions 54 of filament supports 14 and 16 are attached to opposite ends of filament 10 by one of several methods, as known in the art, such as crimping or welding. In the filament assembly 70, the filament supports 14 and 16 and the filament 10 share a common axis 71. The inlead portions 52 of filament supports 14 and 16 are connected to molybdenum foil conductors 24 and 32, respectively. The external leads 22 and 30 and the filament supports 14 and 16 are typically fabricated of molybdenum, but other materials, such as tungsten, may also be suitable.

As described above, due to variations in the inside diameter of lamp envelope 12 from lamp to lamp, the filament supports 14 and 16 must be sized a few thousandths of an inch smaller than the nominal inside diameter of the lamp envelope. The lack of an intimate fit between the filament supports 14 and 16 and the lamp envelope 12 can result in variations in the position of the filament 10 relative to the lamp envelope 12. This, in turn, can lead to variations in lamp performance.

The lack of an intimate fit between the filament supports 14 and 16 and lamp envelope 12 is overcome in accordance with the present invention by a process known as "tacking". The tacking process deforms the lamp envelope 12 around the filament supports 14 and 16, thereby creating an intimate locking fit and securing the filament 10 in a fixed position relative to lamp envelope 12. The result of tacking is illustrated in FIG. 1 as regions **12*a* and 12*b* of lamp envelope 12, which have been deformed into contact with filament supports 14 and 16**, respectively.

Figure 4A:
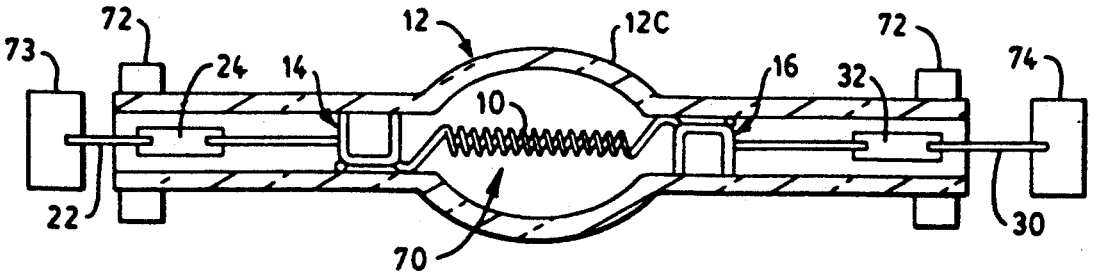
FIGS. 4A–4D illustrate the steps in the fabrication of the lamp capsule of FIG. 1 in accordance with a first embodiment of the invention.

The tacking process is performed during the lamp making process. A first embodiment of the tacking process is illustrated in FIGS. 4A–4D. A tubular blank of the lamp envelope is mounted in a holding fixture 72, as shown in FIG. 4A. The blank of the lamp envelope 12 may include an ellipsoidal or other shaped region **12*c* and is open at each end. The blank of the lamp envelope 12 is mounted in holding fixture 72 in a vertical orientation (not illustrated in FIG. 4A). Then, the filament assembly 70 is lowered into the lamp envelope so that filament 10 is located within region 12*c*. The external leads 22 and 30 of the filament assembly 70 are secured in holding fixtures 73 and 74**, respectively, which are separately movable in an axial direction.

Next, the axial and radial positions of the filament 10 relative to the lamp envelope 12 are determined using a calibrated measurement system, such as a vision system (not shown). The vision system employs a light source on one side of the lamp envelope and filament assembly and a video camera on the opposite side. The video camera receives an image of the shadow of the filament assembly, which is processed according to known image processing techniques to determine the position of the filament 10 relative to lamp envelope 12. When the actual filament position, as determined by vision system, differs from a desired filament position, the filament position is corrected by moving one of or both of the holding fixtures 72 and 73 which hold external leads 22 and 30. Both the axial position and the stretch of the filament are determined and corrected as necessary.

When the correct filament location and stretch are established, the exterior of the lamp envelope 12 is locally heated, preferably with a torch, in region 12*a* adjacent to filament support 14. The heating is represented schematically in FIG. 4B by an arrow 76. The lamp envelope 12 is heated in region 12*a* to a temperature sufficient to soften the lamp envelope material. The heating causes the lamp envelope to deform, or collapse, around filament support 14. Since the lamp envelope 12 is preferably locally heated only in the region 12*a*, the remainder of the lamp envelope remains rigid and is not deformed.

During the heating operation and for a short cooling time thereafter, the interior of the lamp envelope 12 is flushed with an inert gas or a reducing gas to prevent oxidation of the interior metal parts. Preferably, the interior of the lamp envelope is flushed with nitrogen or argon, sometimes blended with small quantities of hydrogen. If necessary, the internal pressure of the lamp envelope can be reduced to facilitate the deformation of the lamp envelope around the filament support. Any internal pressure lower than the external atmospheric pressure tends to draw the lamp envelope 12 inwardly into contact with filament support 14 in the heated region. Also, if necessary, mechanical pressure can be applied to the exterior of the lamp envelope in heated region 12*a* to facilitate deformation of the lamp envelope around filament support 14. The mechanical pressure can be applied with any suitable counter opposed metal jaws. It will be understood that uniform deformation of the lamp envelope 12 in heated region 12*a* is not necessary. It will also be understood that reduction of the pressure in the lamp envelope and application of mechanical pressure are optional techniques which can be utilized separately or in combination as necessary. The lamp envelope 12 in the heated region 12*a* deforms around filament support 14 and secures it in position after cooling. The relative positions of filament 10 in lamp envelope 12 are maintained by the holding fixtures 72,73 and 74 until the lamp envelope has cooled.

Figure 4B:
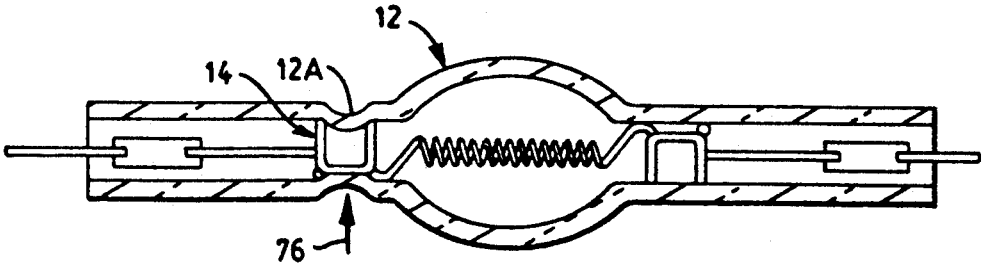
Figure 4C:
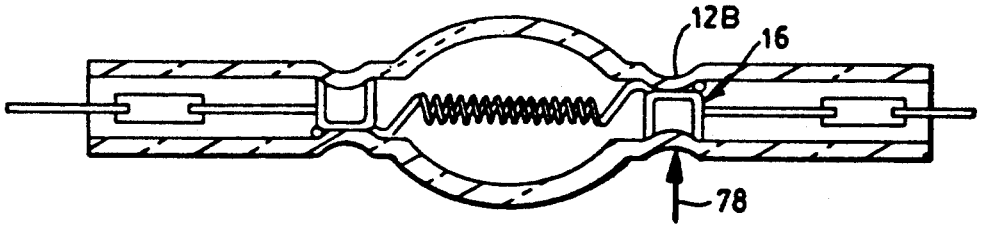

Next, the exterior of the lamp envelope 12 is locally heated with a torch in the region 12*b* adjacent to the filament support 16, as represented schematically by an arrow 78 in FIG. 4C. The heating causes the lamp envelope in region 12*b* to deform and collapse around filament support 16 as described above in connection with FIG. 4B. The tacking of lamp envelope 12 to filament support 16 in region 12*b* is performed in the same manner described above in connection with tacking in region 12*a*. The tacking process can be performed at different times at regions 12*a* and 12*b* of lamp envelope 12, as illustrated in FIGS. 4B and 4C. Alternatively, the lamp envelope 12 can be heated in regions 12*a* and 12*b* simultaneously to provide simultaneous tacking in regions 12*a* and 12*b*.

Figure 4D:
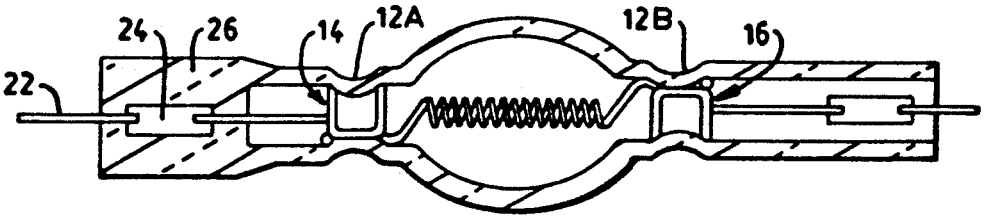

After the tacking process has been completed in regions 12*a* and 12*b*, the lamp envelope 12 is sealed, typically by press sealing or vacuum sealing. As shown in FIG. 4D, seal 26 is formed at one end of lamp envelope 12. The sealing process hermetically seals the lamp envelope and seals molybdenum foil conductor 24 to the lamp envelope material. As a result, electrical energy can be coupled through seal 26 to filament support 14 for energizing filament 10 while maintaining a hermetic seal. Techniques for sealing of quartz lamp envelopes to molybdenum foil conductors are well known to those skilled in the art. Then, the interior of lamp envelope 12 is flushed and backfilled with an inert gas and one or more halogen compounds such as HBr or $CH_3Br$. Finally, the seal 34 is formed at the opposite end of the lamp envelope 12, as shown in FIG. 1, to provide a finished lamp capsule.

Figure 5A:
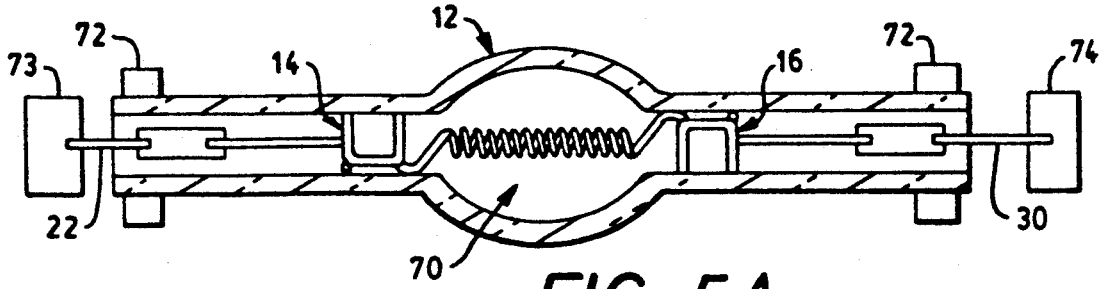
FIGS. 5A–5D illustrate the steps in the fabrication of a lamp capsule in accordance with a second embodiment of the invention.

A second embodiment of the lamp fabrication process of the present invention is illustrated in FIGS. 5A–5D. The lamp envelope 12 is mounted in the holding fixture 72, as shown in FIG. 5A. The filament assembly 70 is located within lamp envelope 12 and the external leads 22 and 30 are mounted in separately movable holding fixtures 73 and 74, respectively, as described above. The position of filament 10 relative to lamp envelope 12 is determined, and the filament position is adjusted if necessary, as described above.

Figure 5B:
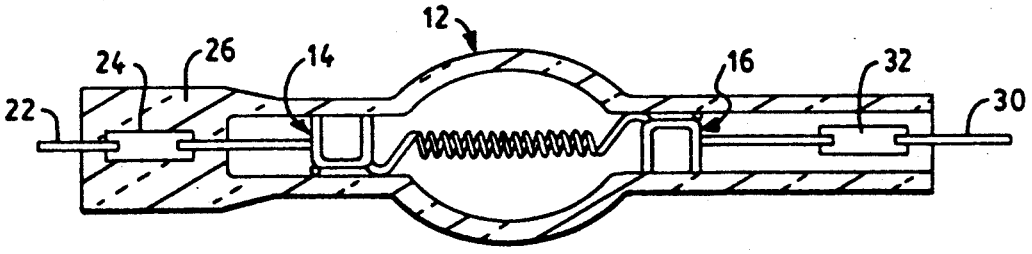

Next, one end of the lamp envelope 12 is sealed, preferably by a press sealing or vacuum sealing process, to form seal 26, as shown in FIG. 5B. As indicated above, techniques for sealing are well known to those skilled in the art.

Figure 5C:
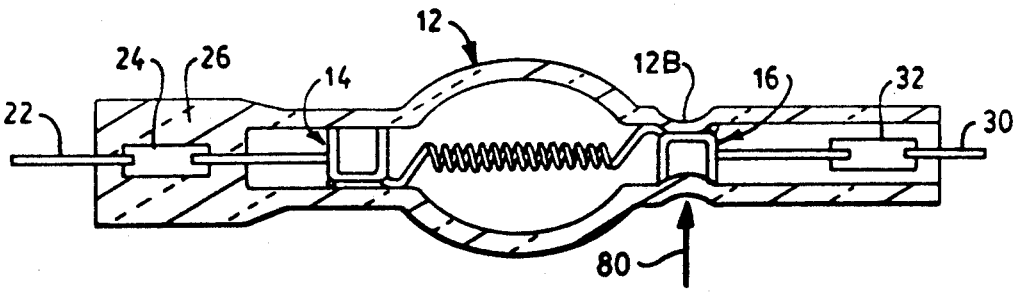

After the seal 26 has been completed, the exterior of lamp envelope is locally heated, preferably with a torch, in the region 12*b* adjacent to filament support 16, as represented schematically in FIG. 5C by arrow 80. The heating causes the lamp envelope 12 to deform and collapse around the filament support 16 and secures the filament support 16 in a fixed position relative to lamp envelope 12 after cooling. The tacking of lamp envelope 12 to filament support 16, as shown in FIG. 5C, is performed in the manner described above in connection with FIGS. 4B and 4C.

Figure 5D:
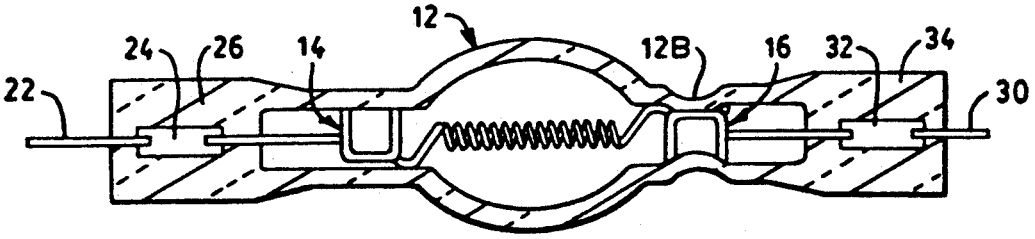

Next, the lamp envelope 12 is flushed and backfilled with the desired gaseous fill, and the other end of lamp envelope 12 is sealed to form seal 34, as shown in FIG. 5D. In this embodiment, the tacking process is performed at only one end of the lamp envelope 12. The sealing operation provides sufficient anchoring of one end of the filament assembly to eliminate the need for tacking at that end.

When the glass or quartz lamp envelope is deformed around the filament support, it is not necessary for the glass or quartz to adhere to the filament support. Mechanical entrapment is generally sufficient to maintain filament position. Filament supports 14 and 16 described above are designed to contact the inner surface of the lamp envelope at two arcuate, axially spaced-apart contact regions. This configuration of the filament supports facilitates positioning of the filament by tacking. When the lamp envelope is heated and deforms around the filament support, the lamp envelope contacts the filament support at the arcuate contact regions defined by arcuate segments 60 and 62. In addition, the lamp envelope material can deform into the spaces between arcuate segments 60 and 62, thereby securely holding the filament supports after cooling. By contrast, helical filament supports may not have sufficient space or spaces between the turns of the helical coil to permit deformation of the lamp envelope. As a result, prior art helical filament supports are less securely held after the tacking process.

Additional filament supports suitable for use with the tacking process are disclosed in application Ser. No. 07/815,089 entitled Filament Support For Tubular Lamp Capsule, filed concurrently herewith, which is hereby incorporated by reference.

The tacking process shown and described herein can also be utilized in arc discharge lamps. Arc discharge lamps typically have two electrodes mounted in opposite ends of an arc tube that is similar in construction to the lamp envelope of the tubular incandescent lamp capsule described above. Precise spacing between the electrodes is required. The electrodes are coupled to external leads by molybdenum foil conductors. The tacking process described above can be utilized to anchor the electrodes within the arc tube.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A method for making a double-ended incandescent lamp capsule having an elongated lamp envelope comprising a central region, first and second seal regions in each end thereof, a first filament-support region between said first seal region and said central region, and a second filament-support region between said second seal region and said central region, said method comprising the steps of:

positioning a filament assembly within said lamp envelope, said filament assembly comprising a filament and first and second filament supports attached to each end of said filament, such that said filament is within said central region of said lamp envelope, said first filament support is within said first filament-support region of said lamp envelope, and said second filament support is within said second filament-support region of said lamp envelope;

heating said first filament-support region of said lamp envelope sufficiently to cause said first filament-support region to deform into contact with said first filament support so as to securely retain said first filament support within said lamp envelope; and sealing said lamp envelope by closing at least one of said seal regions of said lamp envelope.

2. A method as defined in claim 1 wherein said first and second filament-support regions are heated sufficiently to cause said first and second filament-support regions to deform into contact with said first and second filament supports, respectively, so that said first and second filament supports are securely retained within said lamp envelope.

3. A method as defined in claim 2 wherein said first and second filament-support regions of said lamp envelope are heated simultaneously.

4. A method as defined in claim 1 wherein said first filament-support region of said lamp envelope is tubular and the step of heating said first filament-support region causes the inner diameter of said filament-support region to be reduced.

5. A method as defined in claim 1 wherein the step of positioning said filament assembly includes the steps of determining the precise alignment of said filament relative to said lamp envelope and adjusting the alignment of said filament when necessary.

6. A method as defined in claim 5 wherein said filament comprises a wire coil and the step including the precise alignment of said filament assembly further includes the steps of determining the stretch of said wire coil and adjusting the spacing between successive turns of said wire coil when necessary.

7. A method as defined in claim 1 wherein the step of heating said first filament-support region of said lamp envelope is performed with a torch.

8. A method as defined in claim 1 further including the step of flushing an inert gas or a reducing gas through the lamp envelope during the step of heating said first filament-support region of said lamp envelope.

9. A method as defined in claim 1 further including the step of reducing the pressure within the lamp envelope to less than the pressure outside the lamp envelope during the step of heating said first filament-support region of said lamp envelope.

10. A method as defined in claim 1 further including the step of applying mechanical pressure to said heated first filament-support region of said lamp envelope to cause said first filament-support region of said lamp envelope to be deformed.

11. A method as defined in claim 1 wherein said filament assembly includes first and second lead-in wires connected to said first and second filament supports by first and second conductive foils, respectively, said method further including the step of closing said second seal region of said lamp envelope on said second lead-in wire and second conductive foil so as to anchor one end of said filament assembly in said lamp envelope prior to heating said first filament-support region of said lamp envelope.

12. A method as defined in claim 11 wherein the step of positioning said filament assembly includes the steps of determining the precise alignment of said filament relative to said lamp envelope and adjusting the alignment of said filament when necessary.

13. A method as defined in claim 12 wherein said filament comprises a wire coil and the step including the precise alignment of said filament assembly further includes the steps of determining the stretch of said wire coil and adjusting the spacing between successive coils of said wire coil when necessary.

* * * * *